US008262419B2

(12) United States Patent
Chen et al.

(10) Patent No.: US 8,262,419 B2
(45) Date of Patent: Sep. 11, 2012

(54) CONTACT FOR ELECTRIC CONNECTOR AND METHOD OF MAKING THE SAME

(75) Inventors: Ke-Hao Chen, New Taipei (TW); Hsiu-Yuan Hsu, New Taipei (TW); Chih-Kai Yang, New Taipei (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/184,577

(22) Filed: Jul. 18, 2011

(65) Prior Publication Data

US 2012/0015565 A1 Jan. 19, 2012

(51) Int. Cl.
*H01R 13/24* (2006.01)

(52) U.S. Cl. ..... 439/700

(58) Field of Classification Search ..... 439/700, 439/66, 246, 500
See application file for complete search history.

(56) References Cited

U.S. PATENT DOCUMENTS

| | | | | |
|---|---|---|---|---|
| 7,025,602 | B1 | 4/2006 | Hwang | |
| 2010/0068947 | A1 * | 3/2010 | Hsiao et al. | 439/786 |
| 2011/0171839 | A1 * | 7/2011 | Yang et al. | 439/66 |

FOREIGN PATENT DOCUMENTS

| | | |
|---|---|---|
| TW | M356263 | 5/2009 |

* cited by examiner

*Primary Examiner* — Tulsidas C Patel
*Assistant Examiner* — Phuongchi Nguyen
(74) *Attorney, Agent, or Firm* — Wei Te Chung; Andrew C. Cheng; Ming Chieh Chang

(57) ABSTRACT

A contact includes an upper contact having a planar main board with a plurality of blocks, a lower contact, and a spring. The lower contact includes a first spring arm and a second spring arm which are positioned at opposite sides of the main board of the upper contact. Only the second spring arm defines a recess to receive corresponding block of the upper contact. The spring is fitted over a predetermined area between the upper and the lower contact.

16 Claims, 6 Drawing Sheets

CONTACT FOR ELECTRIC CONNECTOR AND METHOD OF MAKING THE SAME

BACKGROUND OF THE INVENTION

1. Field of the Invention

The present invention relates to a contact terminal configured by an upper contact part slideably and electrically disposed a pair of fork arms of a lower contact part so as to effectively conduct electrical transmission therethrough.

2. Description of Related Art

Taiwanese Utility Pat No. M356263 issued to Shiao et al. on May 1, 2009 discloses a contact for an electrical connector. The contact includes an upper contact, a lower contact, and a spring fitted over a predetermined area between the upper and the lower contact. The upper contact has a lead-in portion with a pair of elastic portions formed by die cutting. Each elastic portion has a hook. The lower contact includes a main body having two mating surfaces. Each mating surface has a pair of blocks formed a channel to lead-in the elastic portion of the upper contact. A tab is defined between two blocks on one surface of the main body for matching with the hook of the upper contact. Therefore, the upper contact and the lower contact are assembled together by the hooks of the upper contact and the tabs of the lower contact.

Since mating surfaces of the upper contact electrically connected with the lower contact is formed by cutting and is thus sharp, so the lower contact may easily destroy by the mating surfaces of the upper contact.

Therefore, an improved contact is needed.

SUMMARY OF THE INVENTION

An object of the present invention is to provide a contact having an upper contact and a lower contact configured to prevent the upper and the lower contacts from being separated from each other and efficiently transmit an electrical signal therebetween.

To achieve the aforementioned object, a contact comprises an upper contact having a planar main board with a plurality of blocks, a lower contact, and a spring. The lower contact includes a first spring arm and a second spring arm extending upwardly and away from each other, the first spring arm and the second spring arm are positioned at opposite sides of the main board of the upper contact. Only the second spring arm defines a recess to receive corresponding block of the upper contact. The spring is fitted over a predetermined area between the upper and the lower contact.

To further achieve the aforementioned object, a method of making a contact comprises: providing an upper contact having a planar main board with a plurality of blocks; providing a lower contact including a second first arm and a second spring arm, the first spring arm being cut and separated from the second spring arm so that a recess is formed on the second spring arm, the recess being used to match with the block; and providing a spring fitted over a predetermined area between the upper and the lower contact.

Other objects, advantages and novel features of the invention will become more apparent from the following detailed description of a preferred embodiment when taken in conjunction with the accompanying drawings.

DETAILED DESCRIPTION OF THE INVENTION

Figure 1:
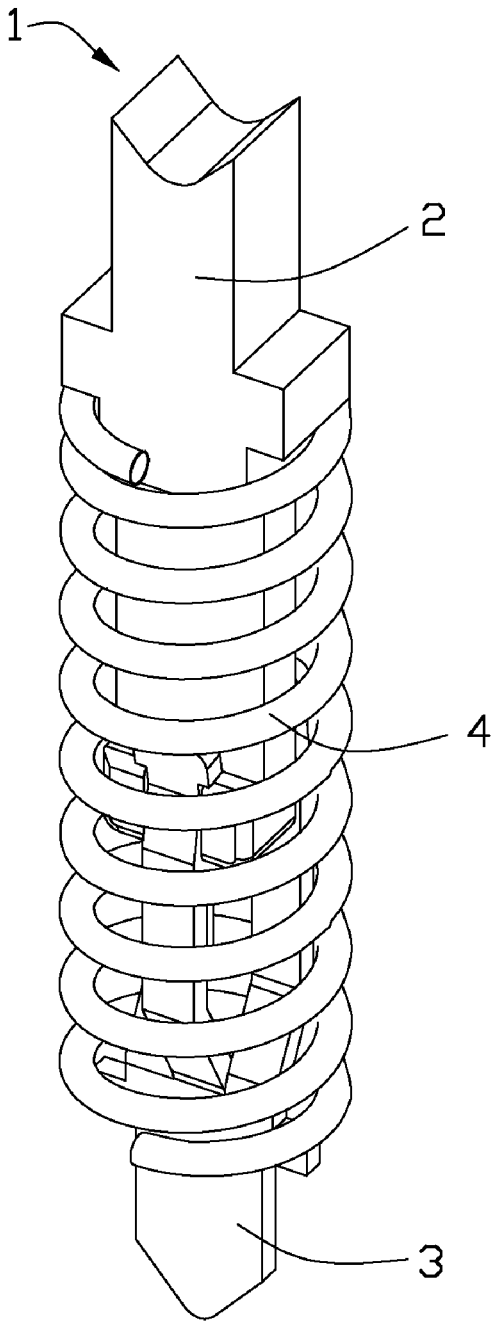
FIG. 1 is an assembly, perspective view of a contact in accordance with the present invention.
Figure 2:
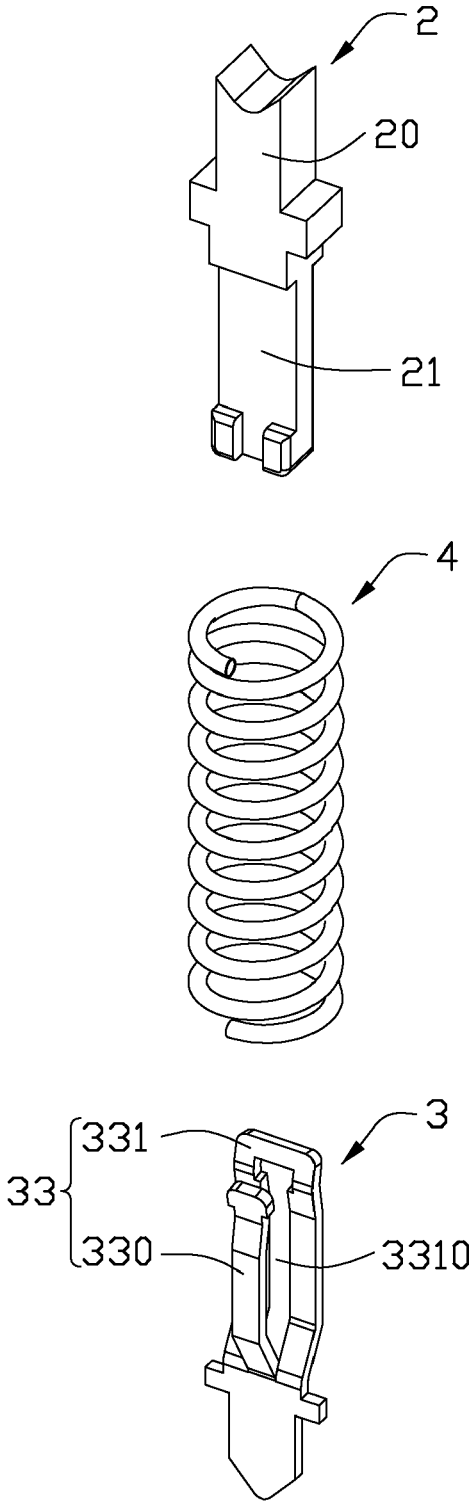
FIG. 2 is an exploded, perspective view of the contact of FIG. 1.

FIGS. 1 and 2 show a contact used in an electrical connector (not shown) for testing an electronic package (not shown). The contact 1 comprises an upper contact 2, a lower contact 3, and a spring 4. The upper contact 2 and the lower contact 3 are coupled to be aligned in a parallel orientation to each other. The spring 4 provides a resilient biasing member which is fitted over a predetermined area between the upper and the lower contacts 2, 3.

Figure 3:
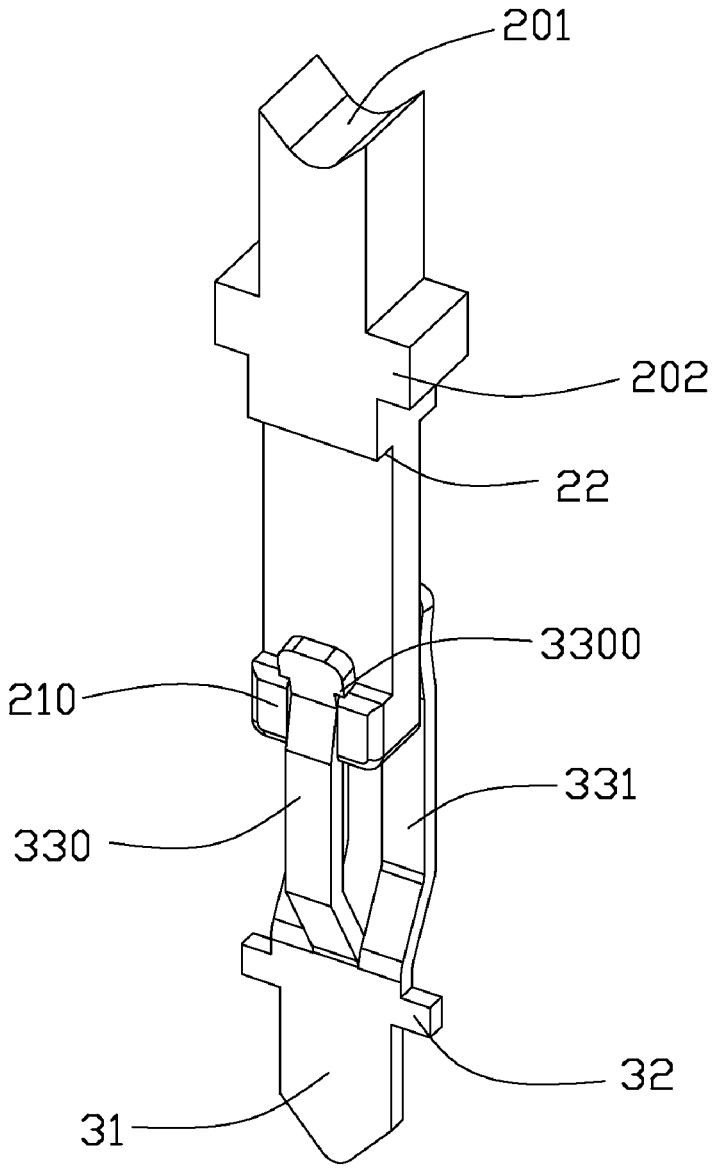
FIG. 3 is an assembly, perspective view of an upper contact and a lower contact of the contact in accordance with the present invention.
Figure 4:
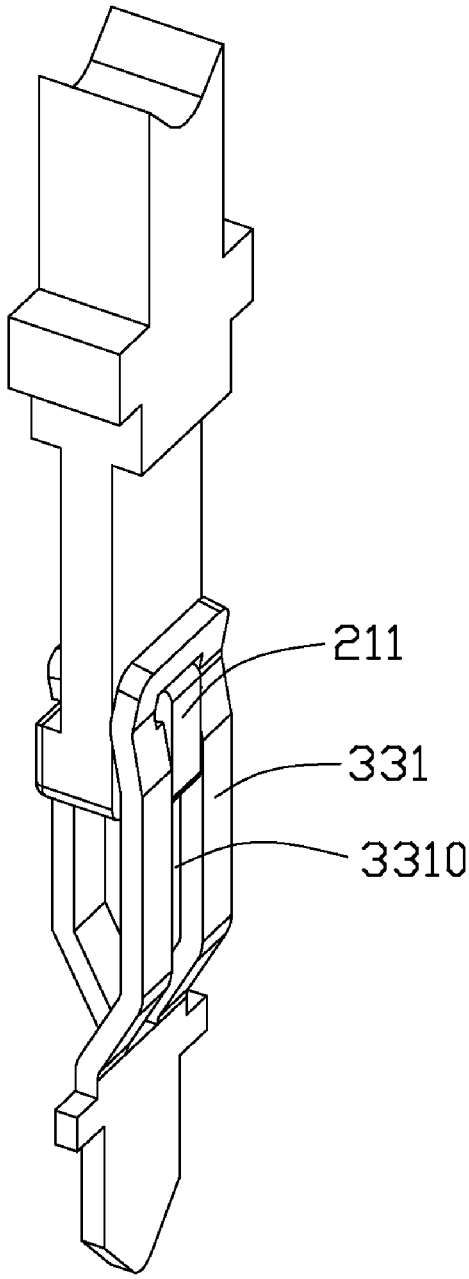
FIG. 4 is the assembly as shown in FIG. 3, taken from another view.
Figure 5:
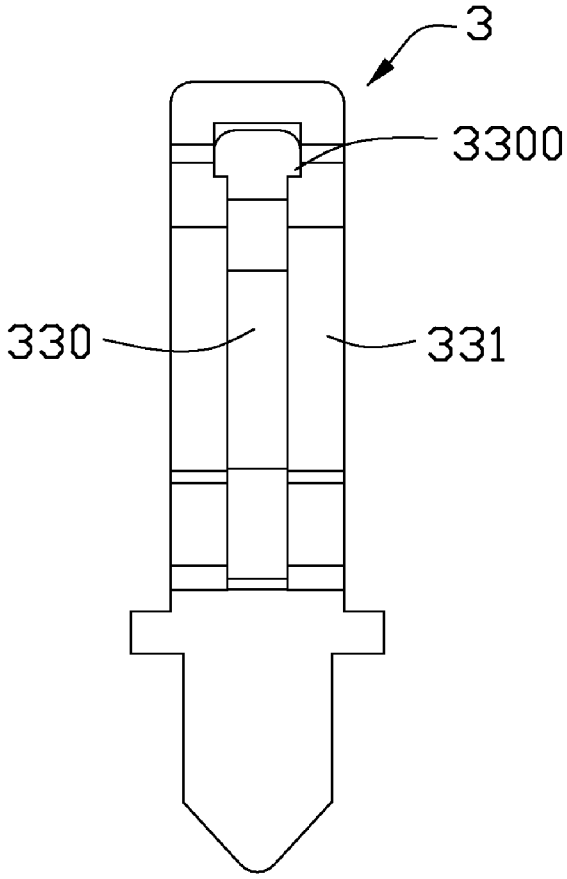
FIG. 5 is a front, perspective view of the lower contact.
Figure 6:
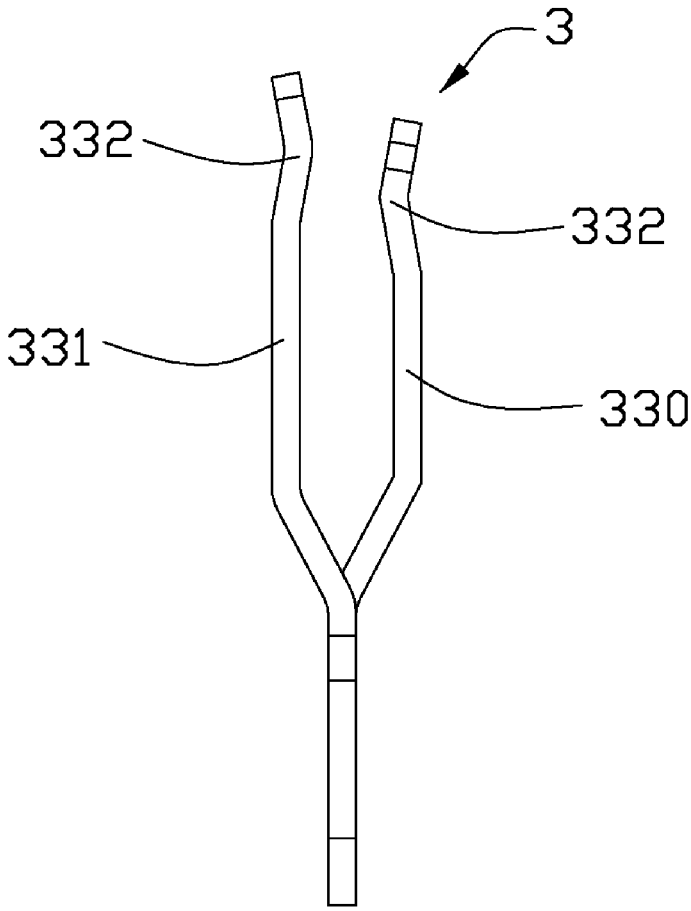
FIG. 6 is a side, perspective view of the lower contact.

Referring to FIGS. 2 to 4, the upper contact 2 is formed with a planar configuration and comprises a thicker head portion 20, a thinner main body 21, and a ladder 22 formed between the head portion 20 and the main body 21. The head portion 20 has a first contact portion 201 which has a curved recess shape. Two first support protrusions 202 are defined at two opposite sides and located between the first contact portion 201 and the ladder 22. The main body 21 has a front and a rear surfaces to engage with the lower contact 3, wherein one of the front and the rear surfaces has two first blocks 210 at end of the main body 21 and the other surface has a second block 211 correspondingly located between the first blocks 210. The first blocks 210 and the second block 211 have outer surfaces which are coplanar with the outer surfaces of the head portion 20.

Referring to FIGS. 2 to 6, the lower contact 3 is produced by a metal sheet. The lower contact 3 comprises a V-shaped second contact portion 31, two second support protrusions 32 positioned above the second contact portion 31, and a spring portion 33 extending upwardly from the second contact portion 31. The spring portion 33 includes a first spring arm 330 inclined toward to one side of the second contact portion 31 and a second spring arm 331 inclined to opposite side of the second contact portion 31, which make the spring portion 33 has a substantially U-shape. The first and the second spring arms 330, 331 have wave portions 332 extending toward to each other for engaging with the upper contact 2. The first arm 330 is a single cantilever and has two flanges 3300 at opposite sides of the end. The second arm 331 is configured into a loop and a recess 3310 is defined thereof. The recess 3310 has a shape substantially the same with the first spring arm 330.

The first and the second spring arms 330,331 of the lower contact 3 are formed as follows: firstly forming the contour line of the first spring arm 330 on the middle of the second spring arm 331 by seamless cutting; then, separating the first spring arm 330 from the second spring arm 331 so as to form a recess 3310 on the second spring arm 331; lastly bending the first and the second spring arm 330,331 to opposite direction and forming substantially a U-shape.

The spring 4 is disposed between the first support protrusions 202 and the second support protrusions 32. The spring portion 33 of the lower contact 3 is located at the opposite sides of the main body 21 of the upper contact 2 and sliding on the main body 21 by non cut surfaces so as to ensure the upper contact 2 is not damaged by the lower contact 3 and establish a well electrical connection between the upper contact 2 and the lower contact 3. A detailed construction is described as follows: the first spring arm 330 of the lower contact 3 is assembled between the two first blocks 210 of the upper contact 2 which are used to support the two flanges 3300 for preventing the upper contact 2 separated to the lower contact 3. The second block 211 of the upper contact 2 is inserted into the recess 3310 of the lower contact 3 and slide in the recess 3310.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. A contact comprising:

an upper contact having a planar main board with a plurality of blocks;

a lower contact including a first spring arm and a second spring arm extending upwardly and away from each other, the first spring arm and the second spring arm positioned at opposite sides of the main board of the upper contact, and the first spring arm being split from the second spring arm to form a recess to receive corresponding block of the upper contact; and a spring fitted over a predetermined area between the upper and the lower contact;

wherein the second spring arm is configured into a loop to form the recess thereof and the recess has a shape substantially the same with the first spring arm.

2. The contact as claimed in claim 1, wherein the first spring arm has a substantially the same shape with the recess of the second spring arm.

3. The contact as claimed in claim 1, wherein upper contact includes two blocks located at one side of the planar main board and one block located at the opposite side of the planar main board.

4. The contact as claimed in claim 1, wherein the first arm is a single cantilever and has two flanges at opposite sides of the end for engaging with the blocks of the upper contact.

5. The contact as claimed in claim 1, wherein the upper contact further includes a head portion extending from the planar main board and thicker than the planar main board, wherein the blocks have outer surfaces which are coplanar with the outer surfaces of the head portion.

6. The contact as claimed in claim 5, wherein the head portion includes a first contact portion which is formed as a curved recess, and the first contact portion defines a pair of first support protrusions positioned at opposite sides thereof for limiting the spring.

7. A contact unit for use within an electrical connector, comprising:

a first contact defining essentially a planar main board defining two opposite main surfaces thereof with two block structures respectively formed on the corresponding two opposite main surfaces;

a second contact defining a pair of spring arms respectively abutting against on said two main surfaces so as to commonly sandwich the planar main board of the first contact therebetween, said pair of spring arms defining a pair of stopping structures at free ends respectively for engagement with the corresponding two block structures, respectively; and a spring having two ends respectively acting upon the first contact and the second contact for constantly urging the first contact and the second contact to move away from each other; wherein the first contact defines a larger thickness than the second contact and defines variant thicknesses at different positions while the second contact is stamped from sheet metal with essentially a constant thickness smaller than that of the first contact under condition that the pair of spring arms are split from each other and one of the pair of spring arms defines a single contact point with the corresponding main surface while the other of the pair of spring arms defines a pair of contact points with the corresponding main surface, the first spring arm and the second spring arm being bent away from each other to make a space therebetween for receiving the main board of the first contact.

8. The contact unit as claimed in claim 7, wherein one of the pair of spring arms is stamped out of the other of the pair of spring arms.

9. The contact unit as claimed in claim 7, wherein said spring is a coil spring.

10. The contact unit as claimed in claim 7, wherein the single contact point and the pair of contact points commonly constitute an isosceles triangle so as to form a balanced and symmetrical arrangement with regard to the first contact.

11. The contact unit as claimed in claim 7, wherein both the first contact and the second contact extend in a planar manner parallel to said two opposite main surfaces.

12. The contact unit as claimed in claim 11, wherein each of said first contact and said second contact defines a pair of lateral protrusions where the corresponding end of the spring abuts against.

13. The contact unit as claimed in claim 7, wherein one block structure on one main surface defines a pair of spaced pieces while the other block on the other main surface defines a unitary piece.

14. The contact unit as claimed in claim 13, wherein said one of the pair of spring arms having the single contact point, is stamped out of the other of the pair of spring arms having the pair of spaced contact points under condition that said one of the pair of spring arms confronts the pair of spaced pieces while said other of pair of spring arms confronts the unitary piece.

15. A contact unit for use within an electrical connector, comprising:

a first contact defining essentially a planar main board defining two opposite main surfaces thereof with two block structures respectively formed on the corresponding two opposite main surfaces;

a second contact defining a pair of spring arms respectively abutting against on said two main surfaces so as to commonly sandwich the planar main board of the first contact therebetween, said pair of spring arms defining a pair of stopping structures at free ends respectively for engagement with the corresponding two block structures, respectively; and a spring having two ends respectively acting upon the first contact and the second contact for constantly urging the first contact and the second contact to move away from each other; wherein the first contact defines a first contact portion at a distal end opposite to the second contact, and the second contact defines a second contact portion at a distal end opposite to the first contact, said second contact portion defining a thickness direction which is perpendicular to the two main surfaces.

16. The contact unit as claimed in claim 15, wherein the first contact defines a larger thickness than the second contact and defines variant thicknesses at different positions while the second contact is stamped from sheet metal with essentially a constant thickness smaller than that of the first contact under condition that the pair of spring arms are split from each other and one of the pair of spring arms defines a single contact point with the corresponding main surface while the other of the pair of spring arms defines a pair of contact points with the corresponding main surface.

* * * * *